US006035046A

United States Patent [19]

Cheng et al.

[11] Patent Number: 6,035,046

[45] Date of Patent: Mar. 7, 2000

[54] RECORDED CONVERSATION METHOD FOR EVALUATING THE PERFORMANCE OF SPEAKERPHONES

[75] Inventors: Frank S. Cheng, East Brunswick; Darren A. Kall, Highland Park; Peter A. Larsson, West End; Scott Michael Pennock, Matawan; Terry Spencer, Fair Haven, all of N.J.

[73] Assignee: Lucent Technologies Inc., Murray Hill, N.J.

[21] Appl. No.: 08/895,876

[22] Filed: Jul. 17, 1997

Related U.S. Application Data

[63] Continuation of application No. 08/544,243, Oct. 17, 1995, abandoned.

[51] Int. Cl.[7] ..... H04R 29/00

[52] U.S. Cl. ..... 381/59; 381/58; 379/410; 379/420

[58] Field of Search ..... 381/58–59, 103; 379/387–392, 400–410, 420

[56] References Cited

U.S. PATENT DOCUMENTS

| | | | |
|---|---|---|---|
| 4,823,391 | 4/1989 | Schwartz | 381/103 |
| 5,187,741 | 2/1993 | Erving et al. | 379/388 |
| 5,361,381 | 11/1994 | Short | 381/103 |
| 5,386,478 | 1/1995 | Plunkett | 381/103 |
| 5,524,060 | 6/1996 | Silfvast et al. | 381/106 |
| 5,890,074 | 3/1999 | Rydbeck et al. | 455/558 |

*Primary Examiner*—Curtis A. Kuntz
*Assistant Examiner*—Duc Nguyen

[57] ABSTRACT

A system and method for testing communication devices, such as speakerphones, are disclosed. In one embodiment, a two-way conversation is pre-recorded for playback through one or more test communications devices to evaluate communications device performance. The test set-up permits the recording of a two-way full-duplex communication onto two or more channels of the same recording/playback device, thereby preserving the content and timing relationships between speech segments. A comparison can be made between the live conversation and the conversation as it was realized in the playback condition over a test communications device. The original and the test will be different based on the performance of the communications device. This method decreases the test time and provides other efficiencies useful in connection with testing, evaluation and quality control for communications device acoustic and network performance testing.

20 Claims, 5 Drawing Sheets

(RECORDING MODE WITH SILENT BACKGROUND)

(RECORDING MODE WITH AMBIENT SOUND)

(RECORDING MODE WITH DELAY)

(RECORDING MODE WITH MULTIPLE LINES)

(TESTING MODE WITH SILENT BACKGROUND)

(TESTING MODE WITH CONFERENCE SPEAKERPHONE)

(TESTING MODE WITH AMBIENT SOUND)

(TESTING MODE WITH CONFERENCE OR BRIDGED LINE)

RECORDED CONVERSATION METHOD FOR EVALUATING THE PERFORMANCE OF SPEAKERPHONES

This application is a continuation of Ser. No. 08/544,243, filed Oct. 17, 1985, ABN.

FIELD OF THE INVENTION

The present invention relates to a system and method for testing communications devices, such as speakerphones, for use in a variety of situations such as prototype testing and benchmarking, competitive evaluation, quality control during the manufacture or repair of such devices, and the evaluation of differences in performance due to environmental conditions.

BACKGROUND OF THE INVENTION

Traditionally, communications devices such as speakerphones, personal communicators and the like have been evaluated with live human conversation in uncontrolled acoustic environments. End-user groups or experienced listeners, commonly called "golden ears," would evaluate audio performance of a device during live conversation and would also execute various tasks designed to stress or "exercise" the device through its intended performance range. However, there are several disadvantages when using live conversation in uncontrolled acoustic environments to evaluate such a device.

First, live conversation is not reproducible. For instance, if two experimenters or evaluators hear a problem while evaluating a communications device, it is difficult to recreate the exact circumstances under which the communications device failed. Each person may not know exactly what he/she was saying at that particular point in time or may not be able to say it in quite the same way. Complex communications devices also often employ dynamically varying internal parameters and apply non-linear processes, making live conversation even more difficult to use for testing. To complicate things even more, communications device performance depends on what is going on at both ends of the telephone line or other connection so that both ends need to coordinate the identity of the speaker(s), the identity of the listener(s) and the content and timing of what is being said, in order to reproduce a particular event. Uncontrolled acoustic environments (e.g., dynamic ambient noise) can also add variability to speakerphone performance.

If a communications device problem cannot be easily reproduced, it is difficult to figure out the root cause of why the communications device failed and how to fix the problem.

Second, when evaluating more than one communications device or device type, or the same communications device in more than one condition or environment, it is sometimes difficult to determine if differences in performance should be attributed to the communications device or environmental factor itself, or variability in the conversation or acoustic environment. Obviously, when performance differences are robust, this does not present much of a problem. However, when differences in performance are small, there is a danger of a confound—concluding that one communications device is better than another simply because the conversation (or any task) held over the communications device stressed one communications device more than the other. For example, the conversation over communications device A may have had twice the amount of double-talk (where people at both ends are talking at the same time) than communications device B—meaning that differences in communications device performance between A and B may be due to differences in the verbal exchange held over them and not differences between the communications devices themselves. Also, there could have been a spike in background noise at the moment one person began to speak.

Third, experimenters or evaluators do not have consistent control of the volume and sound quality of live speech, while the level (dB) and sound quality of recorded speech can be precisely controlled. Live speech makes it difficult to investigate the effects of different speech levels at each end of the telephone line or other connection. Furthermore, even if an experimenter or evaluator was able to speak at a particular level, there is still the problem of saying what was said before inexactly the same way.

Fourth, ambient noise or other background sound is not controlled This normally is not a major problem if the noise is steady-state. However, most real-life ambient noise is dynamic (e.g., traffic noise, people talking in the background, etc.) This dynamic noise can cause variability in communications device performance because spikes in the ambient noise will occur at different times during the verbal interactions. Therefore, for reliable testing, it is not sufficient just to make recordings of dynamic ambient noise. Rather, the recorded noise must be synchronized with verbal interactions over the communications device so that spikes in the noise are introduced at the same point of the verbal interactions upon playback.

Finally, recent advances in communications device technology, such as full-duplex, echo cancellation, noise reduction and the like, and the exponential growth of communications device inclusion in a variety of non-traditional devices (e.g., personal communicators and computers), has made traditional live-conversation methodologies for testing perceived acoustic performance obsolete. This results from the inability of old methods to detect new impairments (echo, variable attenuation, etc.).

Thus, there is a need to make the device testing and evaluation process more efficient, the perceived problems more reproducible, and even small differences in device performance more detectable.

SUMMARY OF THE INVENTION

A system and method for testing communications devices, such as speakerphones, is disclosed. To create a repeatable speech or other auditory stimulus and acoustic environment to test the acoustic or network performance of the devices, a live human conversation (or other series of verbal tasks or other auditory signals) is arranged in a full-duplex sound studio between two or more speakers or sound sources in separate rooms with separate microphones and headphones for acoustic isolation. The auditory signals may be speech, speech-like or non speech-like, and may be produced by human speech (e.g., singing, laughing, clapping) or by artificial means (e.g., white noise, switched pink noise, etc.). These auditory signals are recorded, preferably using a multi-track high-fidelity recording device. Ambient noise may also be recorded onto an independent but synchronized channel of the recording medium.

To perform a test, two or more speakerphones, personal communicators or other communications devices are connected via an actual or simulated telephone, wireless or other communications connection, and are kept in acoustic isolation, such as in separate soundproof rooms or areas. The environment of the rooms may be controlled to evaluate the impact of factors such as reverberation and ambient noise.

The previously-made recording is then played back through two or more "artificial mouths", one in the vicinity of each communications device, such as at a position designed to replicate the expected distance between the device and a human user in an expected live conversation. Meanwhile, an equalizer/ spectrum analyzer coupled to the output of the recording/playback device may be used to control aspects of the conversation signals being sent to the communications units. Acoustic properties may be measured near the output of the "artificial mouths". The ambient noise is played back over separate speakers in the room. A human "golden ear" or evaluator may also be present to perform an evaluation of the acoustic or network quality and performance of the devices.

The present method and system find application in a variety of settings, such as stand-alone testing and evaluation of prototype devices; competitive evaluation; marketing demonstrations; testing during communications device design and development; testing in different acoustic environments; and quality control testing during the manufacture and repair of communications devices. For example, the exact circumstances of a failure can be determined.

DETAILED DESCRIPTION

The present disclosure describes what may be called, for purposes of this disclosure, a "recorded conversation method" (RCM) for testing and evaluating communication devices such as speakerphones. A system for performing the method is also disclosed.

As used in this disclosure, "communications device" is used generically to describe any device capable of sending and receiving sound in a communications environment. Such devices include traditional wired speakerphones; wireless speakerphones; ordinary telephone handsets; wired or wireless devices containing speakers and/or microphones, such as personal communicators or personal digital assistants; and personal computers having built-in microphone/ speaker units. The communications devices may range from half-duplex to full-duplex.

The RCM is part of a family of methodologies designed to meet the need to match technology and application without equivalent increases in the time and expense required to perform communications device or other device testing. A generalized application of the RCM is a highly automated test bed for communication device testing.

The RCM finds particularly useful application as an evaluation tool on prototype speakerphones or other communications devices in development, manufacturing, marketing and repairing. It greatly reduces the time required to perform the evaluation; it provides repeatable error conditions for demonstration to developers; it removes the burden of stimuli creation from a human listener who is judging the system; it reduces the number of different corrections attempted by developers because the exact circumstances of communications device performance are known and the impact of changes made can be attributed to changes in the device rather than the test stimulus or changing ambient noise; it permits a valid comparison between competing devices, between iterative versions of devices or against benchmarks, and the repetitive nature of the stimuli allow human listeners to shorten the development cycle for a particular device because the evaluation is faster, it requires fewer iterations, and moves closer to objective measures that can be used to predict customer acceptance.

Figure 1:
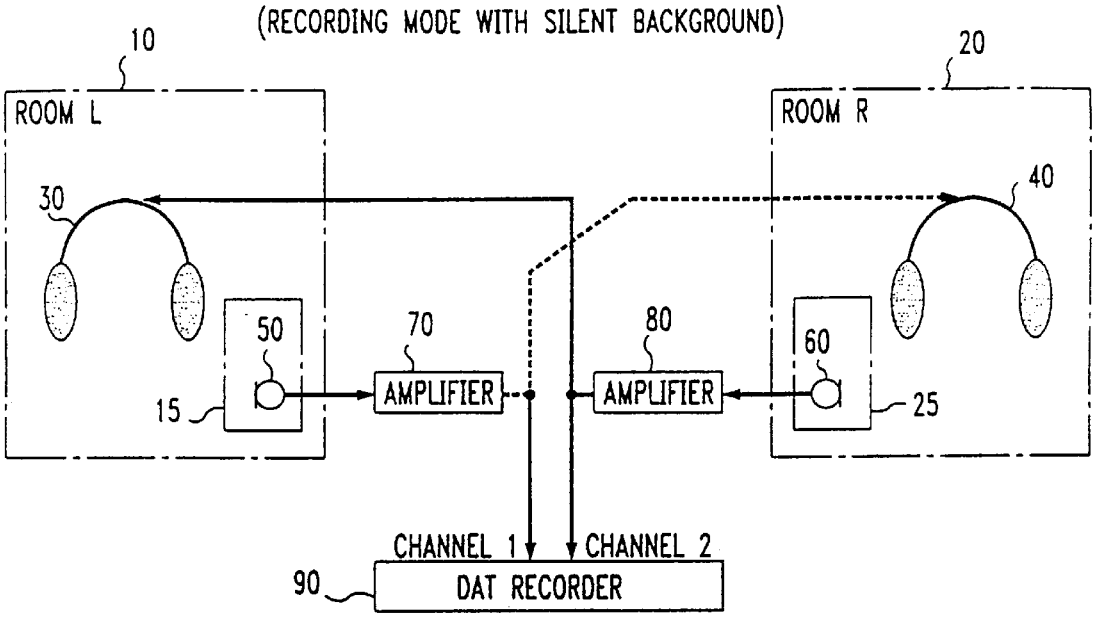
FIG. 1 is a block diagram of one embodiment of the invention, in a recording mode with silent background and no introduced delay.

Turning now to the drawings, FIG. 1 shows a configuration used to make a recording of a human conversation, verbal tasks or other auditory signals. The sounds to be recorded may comprise traditional speech or other series of auditory signals, whether speech-like or not. Examples of such signals include laughing, clapping, white noise, etc. Two or more acoustically isolated rooms or other areas 10, 20 (also called rooms L and R herein) are arranged, each being suitable for a human speaker to engage in typical speech. FIG. 1 shows an arrangement for a silent background, and for this embodiment, the rooms are anechoic. Each room is furnished with a microphone 50, 60. Microphone 50 is arranged to pick up speech and other sounds (such as echo, if any) from room L, and microphone 60 is similarly arranged in room R To make a recording in preparation for later testing, in one embodiment, a human speaker in each room is asked to speak into his or her microphone, either in a normal, spontaneous conversational mode (including pauses and introductions), or while reading text from a specialized script or performing other verbal tasks. Artificial or recorded sounds may be produced instead of or in addition to the human conversation.

Sounds picked up by microphones 50 and 60 are amplified by amplifiers 70 and 80, respectively, and are input to separate input channels 1 and 2 of a high-fidelity recording/ playback device, such as a digital audio tape (DAT) recorder 90. The amplified sounds from microphone 50 are sent to earphones 40, and the amplified sounds from microphone 60 are sent to earphones 30. The DAT or other recording media simultaneously captures the conversation as it occurs, on two or more independent but synchronized tracks, for later playback. Each speaker listens to the other side of the conversation through earphones 30, 40 rather than a loudspeaker so that there is no coupling between the incoming signal (from the other speaker) and the microphone. Each speaker also hears "sidetones", i.e., his or her own voice fed back to his or her earphone. Although not shown in FIG. 1, an output of amplifier 70 is coupled to earphones 30, and an output of amplifier 80 is coupled to earphones 40. In this manner, the speakers experience a full-duplex real-time conversation, and it is preserved for recreation on the DAT recorder 90 or other recording/playback device.

An important reason for recording the conversation on independent but synchronized audio tracks of the same recording medium is to preserve an accurate record of the timing as well as the content of the speech segments produced by the speakers. In one embodiment, DAT recorder 90 is operated at a high digital sampling rate to yield a high-quality recording, using tape having at least two independent but parallel and synchronized recording tracks. Frequency response of each component of the system is preferably flat between 20 and 20,000 Hz, or some other range wider than standard human speech.

Unlike taping on one end of a phone conversation, this set-up avoids several problems: the signals are captured independently—each track of the DAT recorder 90 captures only that speaker; the signals are captured at the highest sampling rates and without the filtering of telephone transmission; and speakers experience a full-duplex taping environment.

Figure 2:
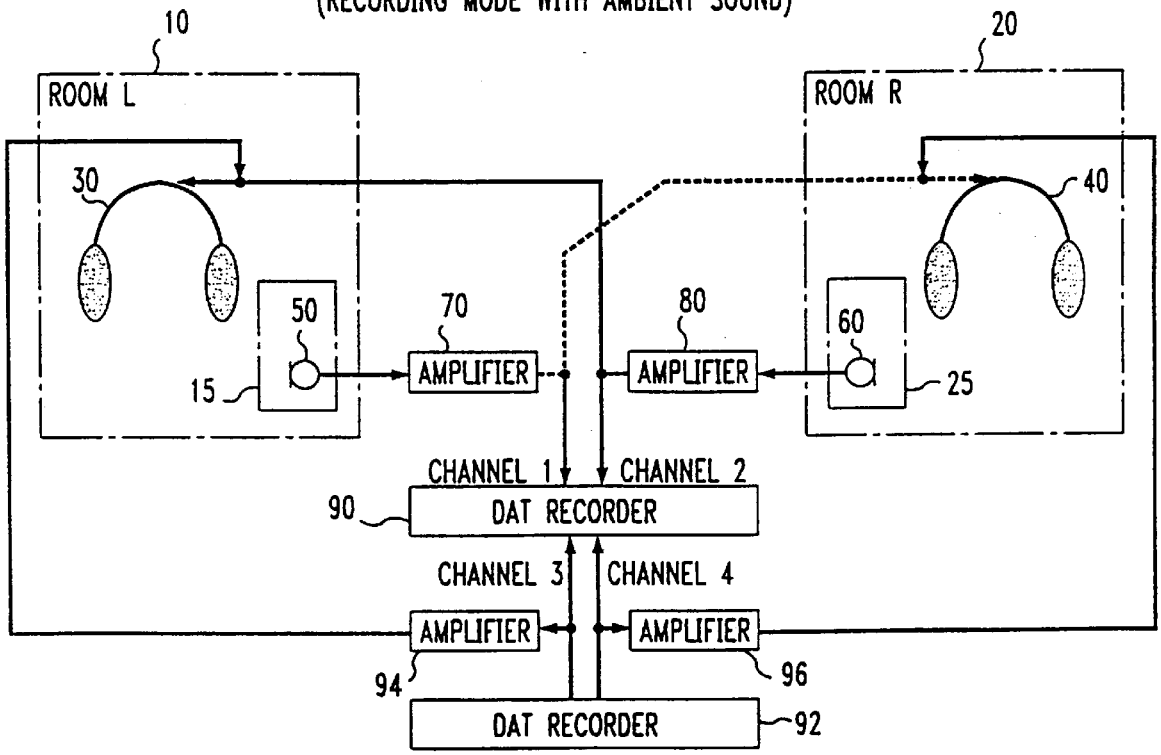
FIG. 2 is a block diagram of another embodiment of the invention, in a recording mode with ambient sound background and no introduced delay.

FIG. 2 is a variation of FIG. 1. In this embodiment, provision is made for the introduction of ambient sound, such as background conversation, traffic noise, etc. A separate recording of ambient sound is played on a separate DAT recorder 92. The audio signal outputs of DAT recorder 92 are amplified by amplifiers 94 and 96, and then sent simultaneously to earphones 30 and 40 and to input channels 3 and 4 of DAT recorder 90. In this variation of the disclosure, DAT recorder 90 has at least 4 record/playback channels, and DAT recorder 92 has at least 2 playback channels. Meanwhile, a conversation takes place (or other sounds are generated) in rooms L and R, as in the case of the FIG. 1 embodiment, which conversation is recorded on channels 1 and 2 of DAT recorder 90 in timed relationship with the ambient sound signals being recorded on channels 3 and 4. This synchronization between ambient sound and the verbal exchange is an important feature of the present disclosure in that it permits repeatability—assuring that the ambient sound coincides with the speech at known time periods in the verbal exchange. Also, the presence of ambient sound adds realism, and the recording of such sound on separate tracks permits independent manipulation of the sound later in a playback mode (discussed below). Alternatively, a series of other auditory signals could be produced in rooms L and R, and recorded simultaneously with the ambient sound.

Figure 3:
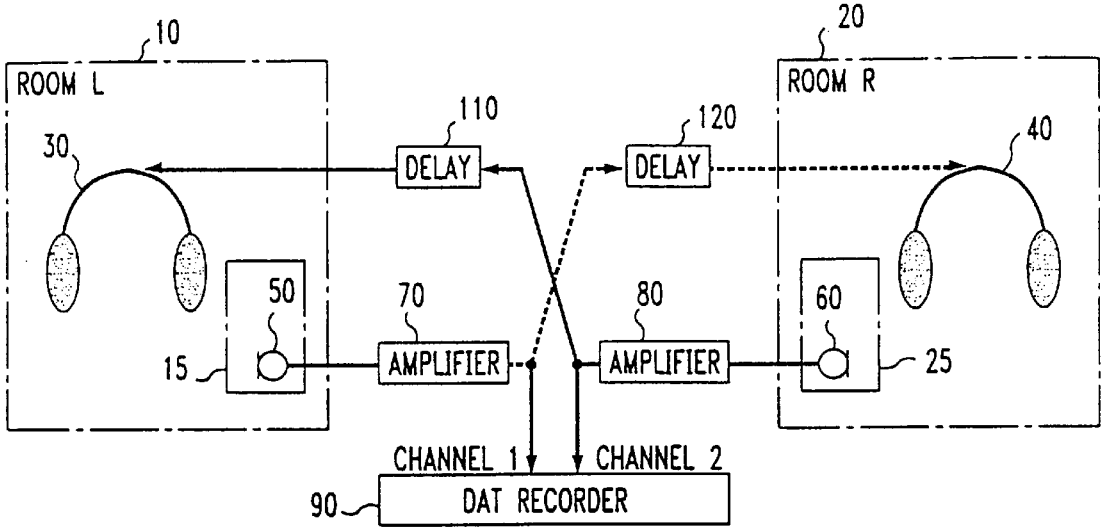
FIG. 3 is a block diagram of another embodiment of the invention, in a recording mode with introduced delay.

FIG. 3, another variation of FIG. 1, will now be described. Since many communication devices now in use have built-in audio processing time delays to accomplish acoustic echo cancellation or to coordinate sound with a video signal, the recording set-up of FIG. 1 may be modified to take this delay into account. Time delay units 110, 120 are introduced in the set-up shown in FIG. 2. Unit 110 is electrically connected between amplifier 80 and earphones 30, and unit 120 is electrically connected between amplifier 70 and earphones 40. In this way, two or more speakers in rooms L and R hear each other's speech delayed by specified amounts of time, but the DAT recorder 90 or other recording/ playback device records each speaker's response as spoken, without delay. A reason for this is that the speakers are responding to a system with delay, and therefore may be faltering, hesitating, interrupting etc. Capturing the delay that is introduced to the recording set-up is not desirable because later, as will be seen in the description of the playback mode, the delay would be doubled. This way, the real-time speech is heard on a system with delay but recorded without the delay, and when the recordings are later played over the test system, the test system adds delay, thereby recreating the original conversational milieu. The delay during recording should match the delay during testing. Ambient sound may or may not be present during the recording mode of FIG. 3.

Figure 4:
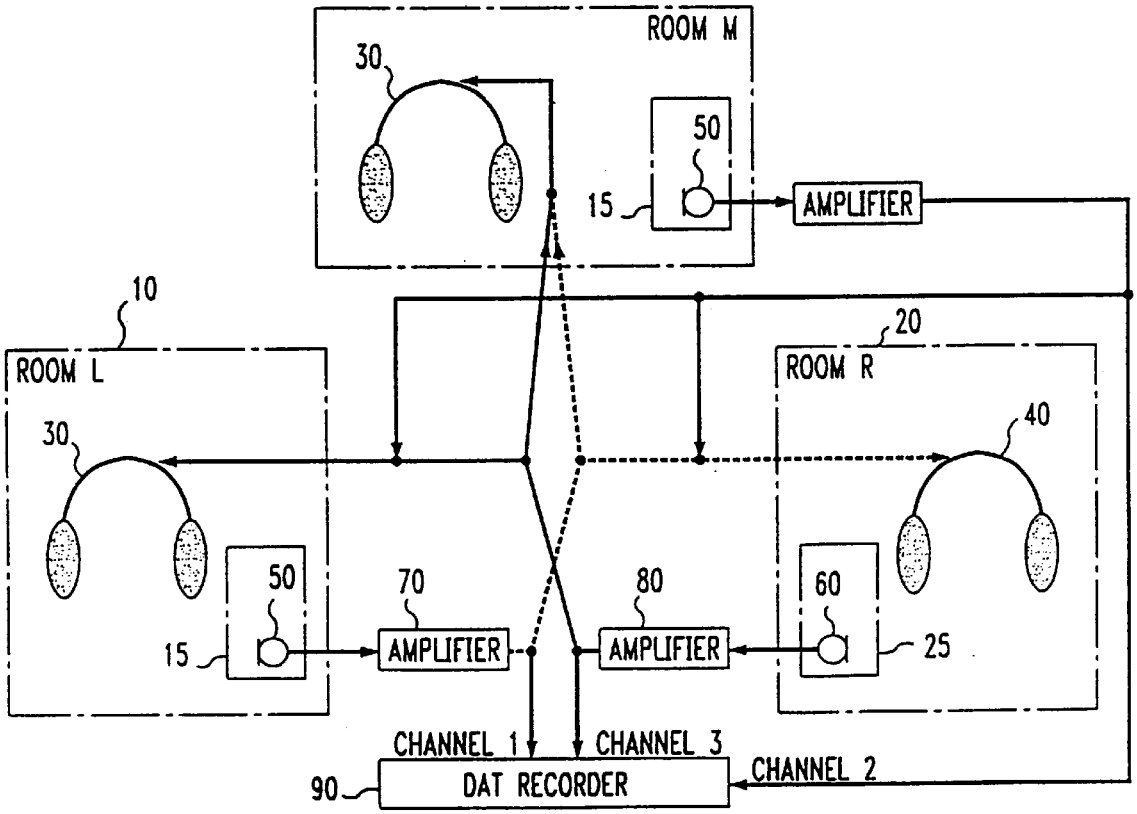
FIG. 4 is a block diagram of another embodiment of the invention, in a recording mode with three or more people collaborating over a communications connection from acoustically isolated rooms.

FIG. 4 is another variation of FIG. 1, illustrating an embodiment of the disclosure in which a recording of a multi-party conversation is made. A third room, labeled room M, is added to accommodate a third speaker or other sound source. Microphone 51 and amplifier 81 are arranged to transmit sound signals to earphones 30 and 40, and to a third input channel of DAT recorder 90. Also, earphones 31 are arranged to receive sound signals from microphones 50 and 60 in rooms L and R, respectively.

Figure 5:
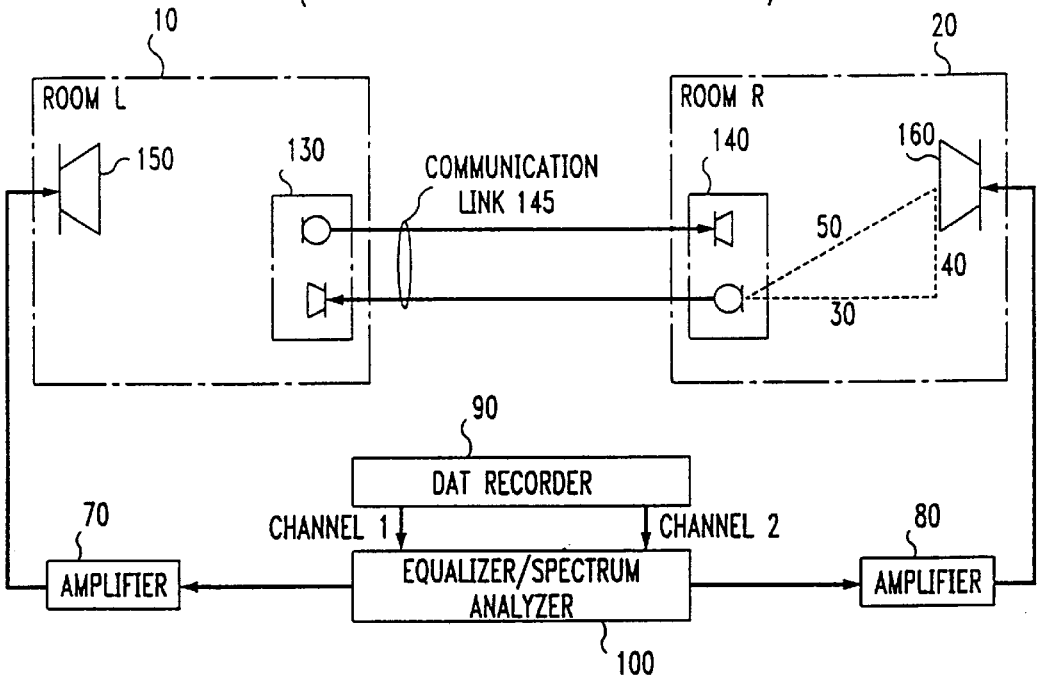
FIG. 5 is a block diagram of another embodiment of the invention, in a testing mode with silent background.

A playback/testing mode of the present disclosure is shown in FIG. 5. For example, to test a particular communications device model or prototype, two similar units 130, 140 are arranged in acoustically isolated rooms or areas 10, 20, respectively. In another example, one of the units 130, 140 could be a different model for comparison testing, such as between competing units, or one or both of the units could be a standard telephone handset. In order to accurately reproduce the expected "real-life" environment of the communications device(s) under test, the units preferably are connected to each other using an actual or simulated network or local communication link 145, such as a wired or wireless telephone connection.

In addition to the communications devices, an "artificial mouth" 150, 160 is placed in each room within audible range of each respective communications device. Each "artificial mouth" comprises a special loudspeaker coupled to a special acoustic housing, the combination of which is capable of reproducing, to a high degree of accuracy, the frequency range, timbre and other sound qualities of a human voice. Such an "artificial mouth" is, for example, commercially available from the Brüel and Kjaer Co. of Sweden. An "artificial head and torso simulator" could also be used to reproduce the recorded speech.

Each artificial mouth is arranged to be electrically driven by the output of one channel of a playback device, such as DAT recorder 90, coupled through amplifiers 70, 80. An optional equalizer/ spectrum analyzer 100 may also be coupled within the circuit to each artificial mouth, for the purpose of displaying the precise volume, frequency and timing of signals from each channel of the DAT recorder.

The position of each artificial mouth 150, 160 relative to each communications device 130, 140 may affect the sound quality transmitted from it to the other communications device. In one embodiment of the present disclosure, as shown in FIG. 5, each artificial mouth 150, 160 is placed at a distance from the communications device that is designed to approximate the relative position of a human speaker under normal circumstances, such as at the apex of a 30 cm×40 cm×50 cm vertically rising triangle and aimed toward the communications device.

To evaluate a particular communications device, a tape (previously made of a live conversation or other auditory signals) is played back on the DAT recorder 90 and over both artificial mouths 150 and 160 while communications devices 130 and 140 are both operating. An evaluator or experienced listener ("golden ear") may, but need not, also be present in one or both rooms. The "golden ear" generally will be familiar with the tape, and will be trained to listen for differences between the recorded speech and the speech as reproduced over the communications devices. An optional equalizer/spectrum analyzer 100 is present for the purpose of viewing and/or adjusting the output volume, frequency response, etc. of the conversation being played back over the DAT recorder, and also for taking acoustic measurements near the artificial mouths. In the embodiment of FIG. 5, ambient sound is minimized with, for example, soundproofing and/or the use of anechoic rooms, to produce a silent or nearly silent background.

In this manner, the tape, which has preserved the original conversational content, frequency range, timing, environmental conditions and other features, together with the artificial mouths, recreates as closely as possible the auditory signals of the original speakers or sound sources.

It should be recalled that, in the present embodiment, delay may be introduced by the device under test, in which case recordings made using the FIG. 3 configuration should be used.

Figure 6:
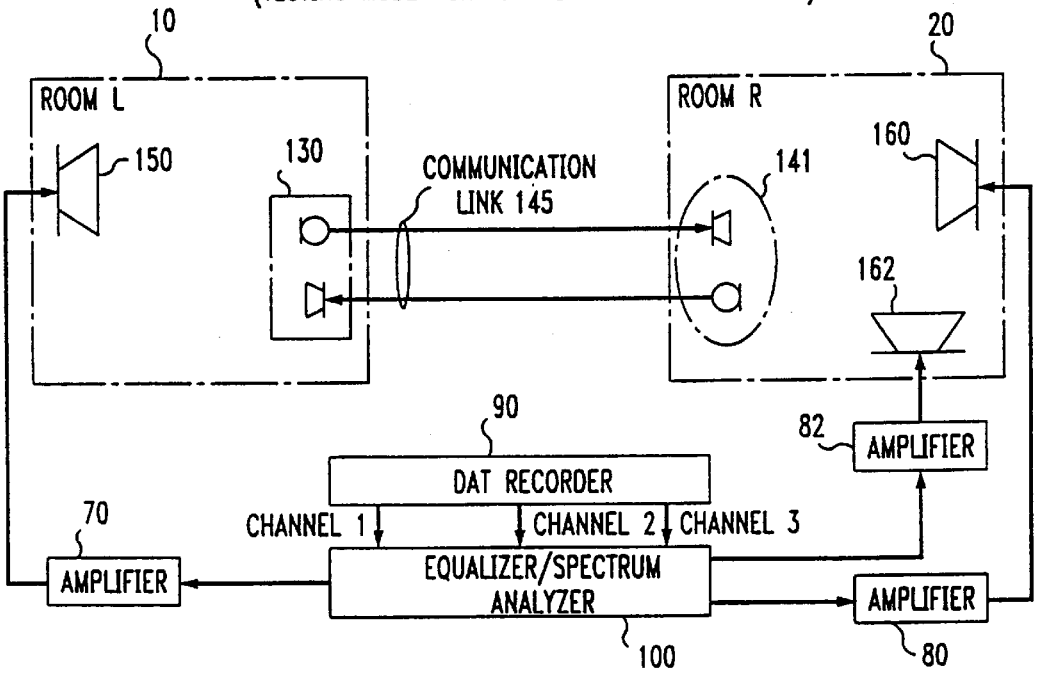
FIG. 6 is a block diagram of another embodiment of the invention, in a testing mode with two or more speakers in the same room, to simulate a conference with multiple speakers at one location.

FIG. 6 is a variation of FIG. 5, in which a recording is played back to a room with equipment arranged to simulate multiple speakers in the same room, such as in a meeting or conference at which several people congregate near a speakerphone or other communications device. In this embodiment, two or more artificial mouths 160, 162 are arranged near a conference speakerphone 141, and driven by sound signals from channels 2 and 3 of DAT recorder 90 through amplifiers 80 and 82.

Figure 7:
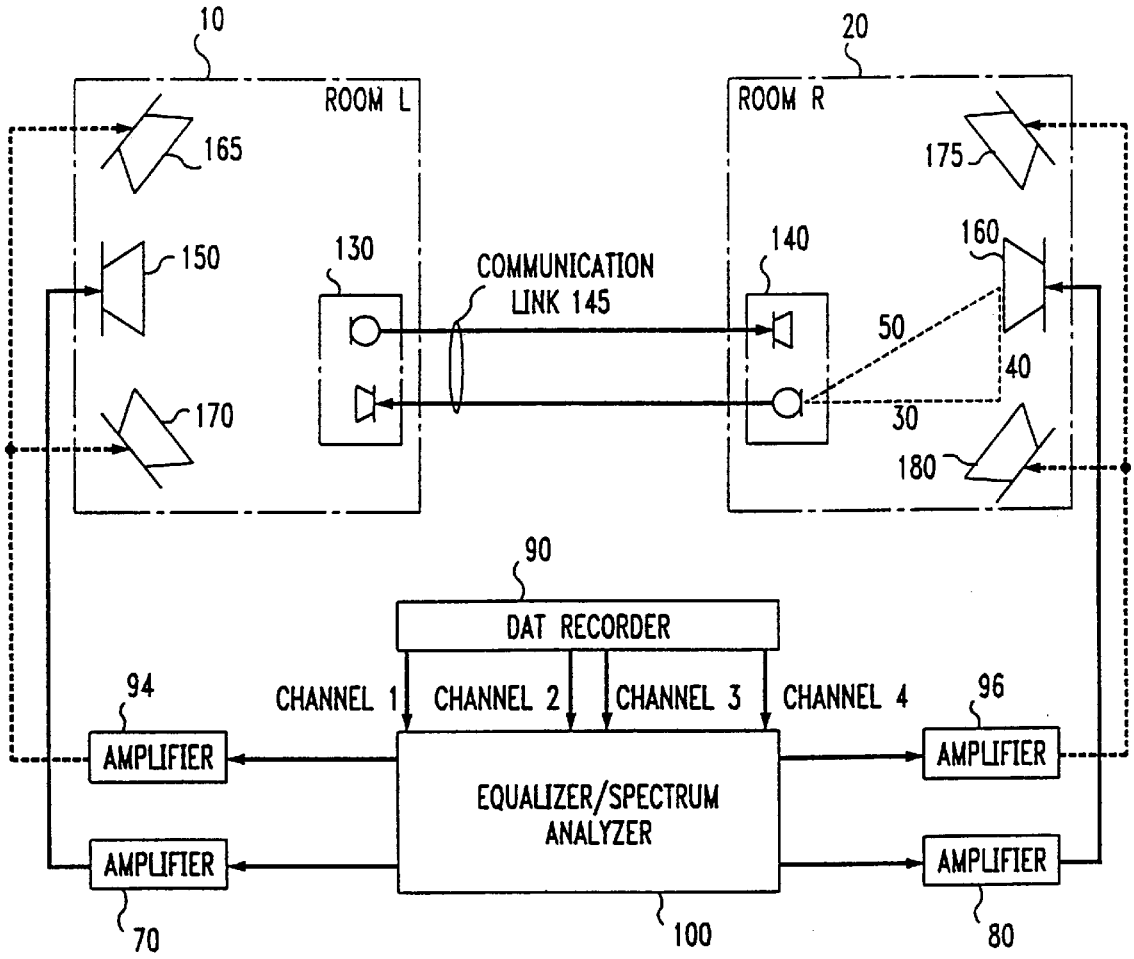
FIG. 7 is a block diagram of another embodiment of the invention, in a testing mode with ambient sound background.

FIG. 7 is a variation of FIG. 5, in which ambient sound is introduced to the devices under test. This shows the testing mode for playing back a recording (containing ambient sound) made using the FIG. 2 configuration. In FIG. 7, DAT recorder 90 preferably is (or is used in the mode of) a 4-channel (or more) audio playback device. Audio signals on output channels 1 and 2 are amplified by amplifiers 70 and 80 and reproduced by artificial mouths 150 and 160, as in the case of FIG. 5. Simultaneously, ambient sound signals previously recorded on channels 3 and 4 are played back, amplified by amplifiers 94 and 96, and then reproduced in rooms L and R by ambient speaker means 165, 170, 175 and 180. If the ambient sound comprises primarily background conversation or speech-like voice components, then ambient speaker means 165, 170, 175 and 180 preferably are artificial mouths. Otherwise, high-fidelity loudspeakers may be employed. The number, type and placement of the loudspeakers is chosen to reproduce the most realistic recreation of ambient sound.

Alternatively, a recording not containing ambient sound may be played in the arrangement of FIG. 7, with ambient sound introduced from other sources.

Figure 8:
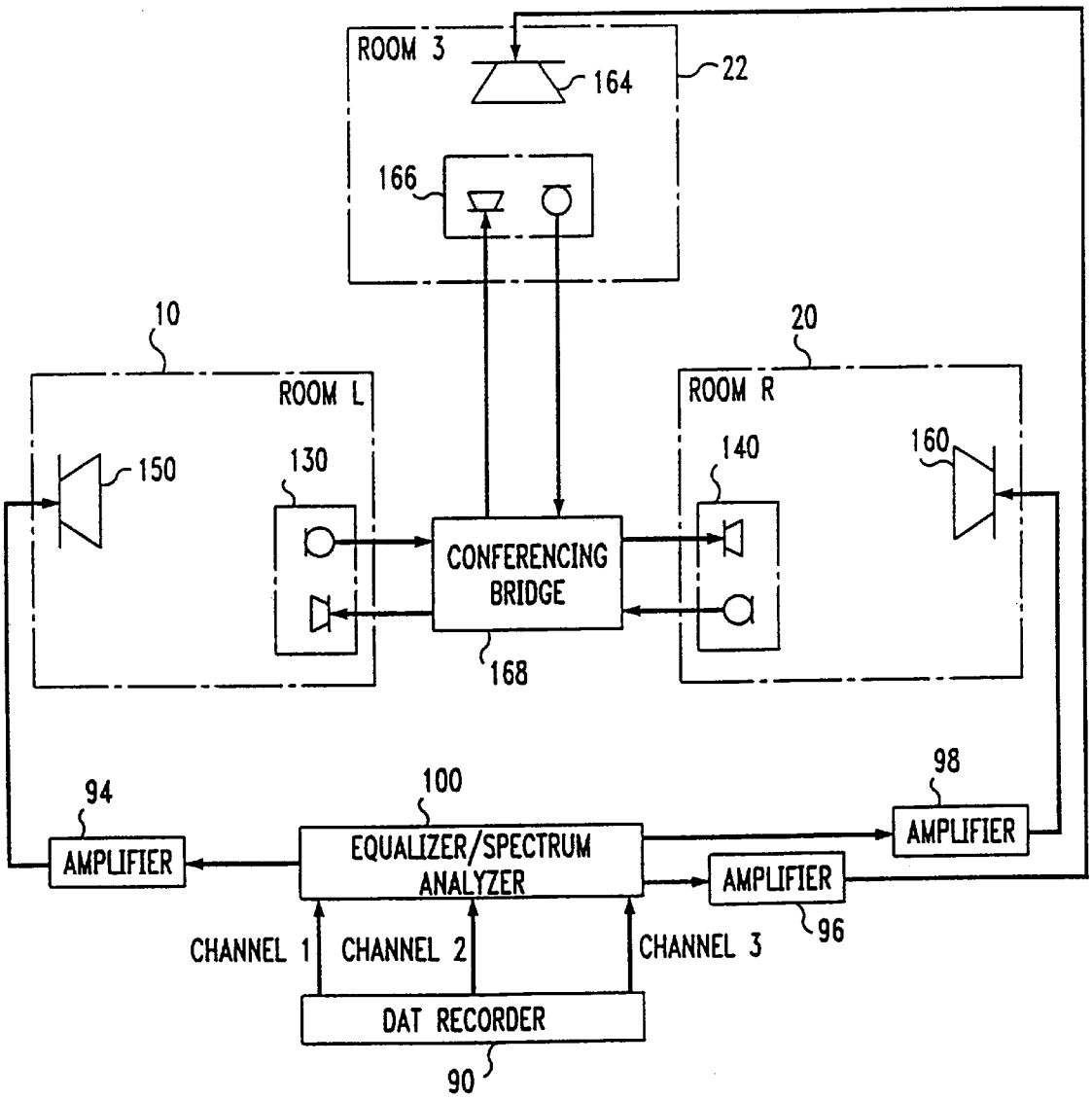
FIG. 8 is a block diagram of another embodiment of the invention, in a testing mode with a multi-point conferencing device.

FIG. 8 is a variation of FIG. 7, in which a recording on more than two tracks of a recording medium is played back into more than two acoustically isolated rooms 10, 20, 22, so as to permit the testing of a multi-point conferencing bridge 168 or related device. Bridge 168 is arranged to couple together three or more communication devices 130, 140, 166, so as to permit the simultaneous testing of all the devices, or of the bridge itself.

The method and system described in this disclosure is useful in many respects. For example, it may be used in connection with a stand-alone testing center for the commercial testing of speakerphones, telephones or other communications devices; as a part of the design and development of new models of communications devices (either iterative testing or comparative testing); as a part of the quality control phase of communications device manufacturing; for marketing demonstrations; and/or for quality control in conjunction with the repair of communications devices.

The embodiments of the present invention may also be used to test various aspects of communication or network links between communications devices. Various parameters, such as line length, noise, signal loss, delay, echo, bridging, etc. may be varied and tested reliably. Other communication link factors that may be tested include echo cancellation schemes, coding schemes (such as asynchronous transfer mode), data compression schemes and bit rate transmission speeds.

While the invention has been shown and described with reference to specific embodiments, it will be appreciated that other variations and combinations may be devised by those skilled in the art. For example, delay could be combined with ambient sound on one or more channels of the recording medium, and 4-party (or more) conferencing arrangements with ambient noise, delay or both, may be tested.

We claim:

1. A method for testing communications devices, comprising the steps of:

recording a series of auditory signals;

establishing a communications link between at least two communications devices;

acoustically isolating said devices;

positioning an artificial mouth at a distance from each said device so as to simulate the expected distance of a human speaker from each said device;

playing back said signals through each said artificial mouth; and analyzing the performance of at least one of said devices.

2. The method of claim 1, in which said communications devices comprise speakerphones.

3. In a method of manufacturing communications devices, the improvement comprising the steps of:

recording a series of auditory signals, said signals being designed to test the performance of a communications device;

acoustically isolating at least two units of said device;

establishing a communications link between said units;

positioning an artificial mouth at a distance from each unit so as to simulate the expected distance of a human speaker from each said unit;

playing back a conversation through each said artificial mouth; and analyzing the performance of at least one said unit.

4. The method of claim 3, in which said communications devices comprise speakerphones.

5. A system for testing one or more units of a communications device, comprising:

an audio recording/playback device, containing a recording on at least two channels of a series of auditory signals designed to test the features of said units, said units being acoustically isolated from each other; and having a communications link established between said units; and at least two artificial mouths, each of which is connected to an output of each channel of said recording/playback device and each of which is arranged to reproduce said recording on each of said channels within audible range of each of said units of said communications device and within audible range of a trained audio listener for analysis.

6. The system of claim 5 in which said communications device comprises a speakerphone.

7. In a system for manufacturing communications devices, the improvement comprising:

an audio recording/playback device, containing a recording on at least two channels of a series of auditory signals designed to test the features of said communications devices, said communications devices being acoustically isolated from each other; and having a communications link established between said devices; and at least two artificial mouths, each of which is connected to an output of each channel of said recording/playback device and each of which is arranged to reproduce said recording on each of said channels within audible range of each of said communications devices and within audible range of a trained audio listener for analysis.

8. The system of claim 7 in which said communications devices comprise speakerphones.

9. The method of claim 1 in which said auditory signals comprises a human conversation.

10. The method of claim 1 in which said auditory signals comprise at least two series of signals, each series being recorded on separate but synchronized tracks of a recording medium.

11. The method of claim 1 in which a time delay is introduced to said series of auditory signals during said recording step.

12. The method of claim 10 in which one said series comprises speech signals and the other of said series comprises ambient sound signals.

13. The method of claim 1 further comprising the step of recreating an original conversational milieu.

14. The method of claim 13 further comprising the step of matching a delay during recording to a delay during testing.

15. The method of claim 1 further comprising the step of synchronizing recorded noise with verbal interactions over said communications device under analysis.

16. The method of claim 3 further comprising the step of recreating an original conversational milieu.

17. The method of claim 16 further comprising the step of matching a delay during recording to a delay during testing.

18. The method of claim 3 further comprising the step of synchronizing recorded noise with verbal interactions over said communications device under analysis.

19. The method of claim 11 wherein said introduction of delay recreates an original conversational milieu.

20. The method of claim 9 wherein said human conversation comprises a real-time, full-duplex conversation.

* * * * *